US010508443B2

(12) United States Patent
Galas et al.

(10) Patent No.: US 10,508,443 B2
(45) Date of Patent: Dec. 17, 2019

(54) SECURING CLIP AND SYSTEM FOR INSTALLATION OF FLOORING ELEMENTS COMPRISING SUCH A SECURING CLIP

(71) Applicant: SALAG SP. Z O.O. SP. K, Suwalki (PL)

(72) Inventors: Adam Galas, Suwalki (PL); Zbigniew Jan Kozlowski, Suwalki (PL)

(73) Assignee: SALAG SP. Z O.O. SP. K, Suwalki (PL)

( * ) Notice: Subject to any disclaimer, the term of this patent is extended or adjusted under 35 U.S.C. 154(b) by 57 days.

(21) Appl. No.: 16/061,038

(22) PCT Filed: Dec. 9, 2016

(86) PCT No.: PCT/IB2016/057466
§ 371 (c)(1),
(2) Date: Jun. 11, 2018

(87) PCT Pub. No.: WO2017/098449
PCT Pub. Date: Jun. 15, 2017

(65) Prior Publication Data

US 2018/0363294 A1 Dec. 20, 2018

(30) Foreign Application Priority Data

Dec. 11, 2015 (PL) ..... 415258

(51) Int. Cl.
*E04B 5/02* (2006.01)
*E04B 1/00* (2006.01)
*E04B 1/41* (2006.01)

(52) U.S. Cl.
CPC ..... *E04B 5/023* (2013.01); *E04B 1/003* (2013.01); *E04B 1/40* (2013.01); *E04B 5/026* (2013.01)

(58) Field of Classification Search
CPC ..... E04B 5/023; E04B 1/0038; E04B 5/12; E04B 1/003; E04B 1/40; E04B 5/026;
(Continued)

(56) References Cited

U.S. PATENT DOCUMENTS 3,619,963 A * 11/1971 Omholt ..... E04F 15/04 52/481.1
8,544,229 B2 * 10/2013 Kilgore ..... E04F 15/02044 52/177

(Continued)

FOREIGN PATENT DOCUMENTS

DE 202015104298 U1 9/2015
FR 1104493 A 11/1955

(Continued)

*Primary Examiner* — Babajide A Demuren
(74) *Attorney, Agent, or Firm* — Browdy and Neimark, PLLC

(57) ABSTRACT

A securing clip for installation of flooring elements on a supporting element having a guiding groove for engagement with the securing clip, the securing clip having a cross section of a double-flange T type with an upper flange, a web and a lower flange, the upper flange being adapted to be engaged on its both sides with neighboring flooring elements, wherein the upper flange (2, 2') comprises at least two parts (2*a*, 2*b*; 2*a'*, 2*b'*) located on the opposite sides of the web (3, 3') and the lower flange (4, 4') comprises lips (5, 5') extending beyond each end the web (3, 3') in the direction along the web (5, 5'), the lips (5, 5') being adapted to be blocked in the guiding groove (6), and in that at least the upper flange (2, 2') is made of elastic material. A system for installation of flooring elements, the system comprising at least one securing clip (1, 1') according to the invention and at least one supporting element (7).

9 Claims, 7 Drawing Sheets

Figure 1:
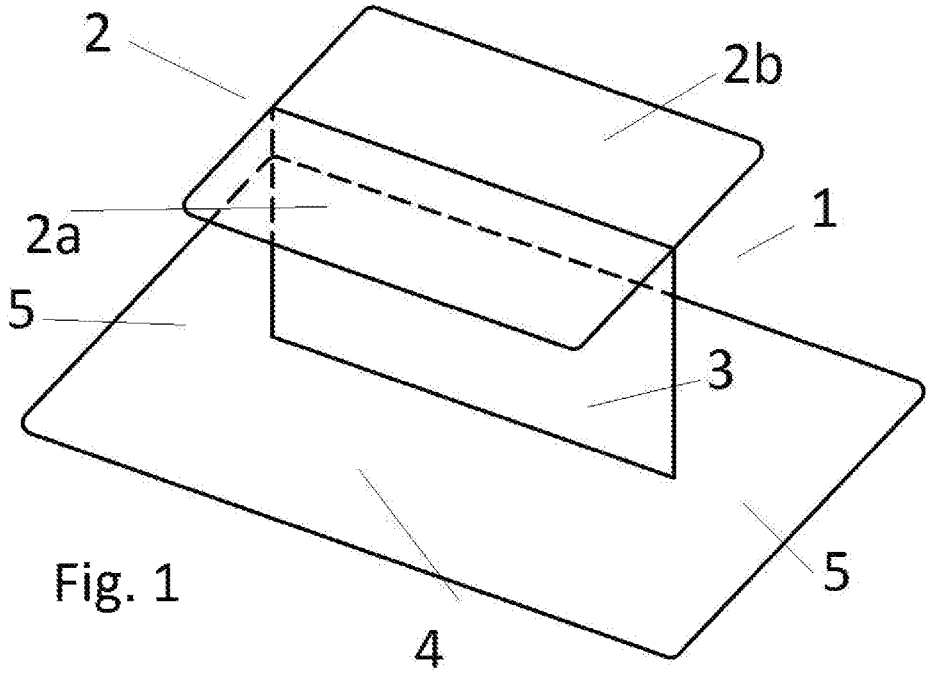

(58) Field of Classification Search
CPC ..... E04F 2015/02094; E04F 15/02044; E04F 15/02183
See application file for complete search history.

(56) References Cited

U.S. PATENT DOCUMENTS

| | | | | |
|---|---|---|---|---|
| 8,672,600 | B2 * | 3/2014 | Reznar | E04F 15/04 411/457 |
| 8,910,442 | B2 * | 12/2014 | Lachevrotiere | E04F 15/02044 52/489.1 |
| 9,580,914 | B2 * | 2/2017 | Fountain | E04F 15/02044 |
| 2014/0096469 | A1 * | 4/2014 | Fountain | E04F 15/02044 52/650.3 |
| 2014/0215944 | A1 * | 8/2014 | Husler | E04F 15/02044 52/302.1 |
| 2015/0128519 | A1 * | 5/2015 | Weber | E04F 15/02038 52/489.1 |

FOREIGN PATENT DOCUMENTS

| | | | |
|---|---|---|---|
| FR | 3001481 | A1 | 8/2014 |
| PL | 159791 | B1 | 1/1993 |
| PL | 67101 | Y1 | 4/2014 |
| WO | 2005024154 | A1 | 3/2005 |
| WO | 20100004539 | A1 | 1/2010 |

* cited by examiner

SECURING CLIP AND SYSTEM FOR INSTALLATION OF FLOORING ELEMENTS COMPRISING SUCH A SECURING CLIP

The present invention concerns a securing clip for installation of flooring elements and a system comprising such a securing clip and a supporting element.

Various types of securing clips for installation of flooring elements are known. The flooring elements may be constituted e.g. by decking planks having mounting flanges on their longitudinal edges or flooring panels, or else regular flooring planks having a rectangular cross-section. The known securing clips, apart from being engaged with a flooring element, must be attached to it by means of fixing means like bolt screws, screws etc.

An example of a securing clip suitable for engagement with mounting flanges of decking planks that requires fixing to supporting elements by means of screws is disclosed in the document WO 2010/004539. The described clip is not very convenient because suitable fixing means and additional tools must be selected and used, which is troublesome and laborious. Besides, demounting of the planks requires the screws to be unscrewed, which may become difficult or even impossible with time. There is also an additional disadvantage consisting in that once the planks have been installed, the holes for the screws remain both in the planks and in the supporting elements.

The aim of the invention was to provide a securing clip and a system for installation of flooring elements enabling to install the flooring elements without the use of fixing means and additional tools.

Another aim of the invention was to provide a securing clip and a system for installation of flooring elements that would be easy to demount and would leave neither holes nor notable traces in the flooring elements and the supporting elements.

Yet another aim of the invention was to provide a securing clip for installation of a flooring element on a supporting element, which securing clip would be made of a single piece of sheet material.

According to the invention a securing clip is provided for installation of flooring elements on a supporting element having a guiding groove for engagement with the securing clip, the securing clip having a cross section of a double-flange T type with an upper flange, a web and a lower flange, the upper flange being adapted to be engaged on its both sides with neighboring flooring elements.

The securing clip according to the invention is characterized in that the upper flange comprises at least two parts located on the opposite sides of the web and the lower flange comprises lips extending beyond each end the web in the direction along the web, the lips being blocked in the guiding groove, and in that at least the upper flange is made of elastic material.

The upper flange may comprise several parts located in pairs on the opposite sides of the web, e.g. four parts, the first pair of said parts being located on one side of the web and the other pair of said parts being located on the other side thereof.

Preferably, the securing clip is made of a single piece of an elastic sheet material that has been repeatedly bent so that the lower flange of the securing clip consists of a lower wall, two side walls and two upper walls that are parallel to the lower wall, and so that the lower wall is formed by a central section of the sheet material, the side and upper walls are formed by the sections of the sheet material adjoining the central section on its both sides, the web consists of two sections of the sheet material adjoining on both sides the sections of the upper walls, with the sections forming the web being shorter than the sections forming the lower flange and both parts of the upper flange being formed by the two opposite border sections of the sheet material.

In another variant of the invention, the securing clip is made of a single piece of an elastic sheet material that has been repeatedly bent so that the lower flange of the securing clip consists of a lower wall, two side walls and two upper walls that are parallel to the lower wall, and so that the lower wall is formed by a central section of the sheet material, the side and upper walls are formed by the sections of the sheet material adjoining the central section on its both sides, the web consists of two sections of the sheet material divided into two parts, adjoining on both sides the sections of the upper walls with the sections forming the web being shorter than the sections forming the lower flange and all the parts of the upper flange being formed by the opposite border sections of the sheet material.

One of the upper walls of the lower flange is preferably provided with means for enhancing the blocking of the lips of the lower flange in the guiding groove.

Preferably, the blocking enhancing means are constituted by free corners of the upper wall that have been bent towards the upper flange.

Also preferably, the external edges extending along the web of all the parts of the upper flange are bent away from the lower flange.

The securing clip according to the invention is preferably made of steel.

According to the invention a system for installation of flooring elements is provided, the system comprising at least one securing clip according to the invention and at least one supporting element comprising a guiding groove for engagement with the at least one securing clip, the dimension of the lower flange of the securing clip measured across the web being smaller than the width of the opening of the guiding groove, and the dimension of the lower flange of the securing clip measured along the web being greater than the width of the opening of the guiding groove.

Preferably, the supporting element is a joist comprising a longitudinal guiding groove at its side adjoining the flooring elements, the opening of the guiding groove being bordered on both sides by longitudinal blocking flanges.

The joist is preferably a profiled element made of plastic material.

The securing clip and the system according to the invention enable simple installation and demounting without the use of additional tools. Therefore it is easy to correct the installation once the planks have been installed. It constitutes a great advantage in relation to the similar known solutions in which e.g. screws must be used making the demounting and servicing much more complicated if not impossible.

Moreover, the system of the invention enables all its components of the flooring to be re-used (when screws are used, holes remain in the connected elements).

Figure 2:
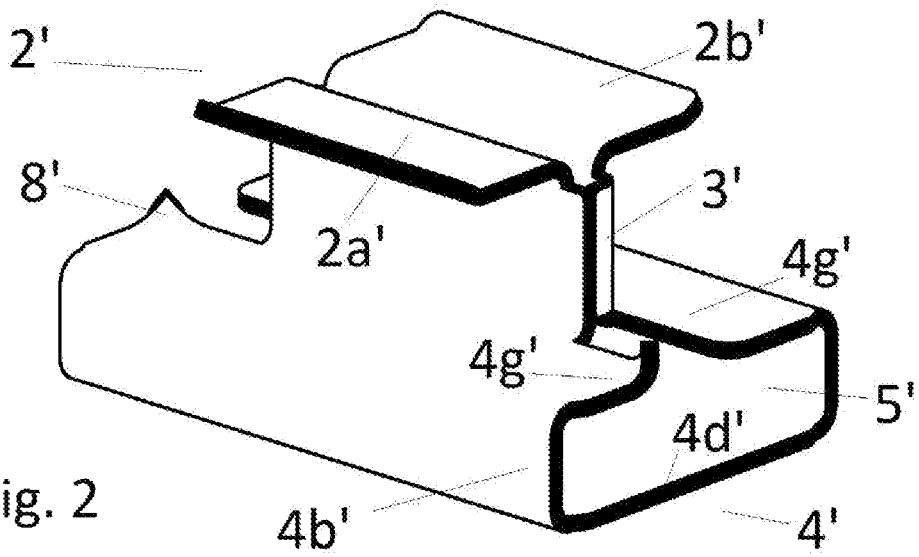
Figure 3:
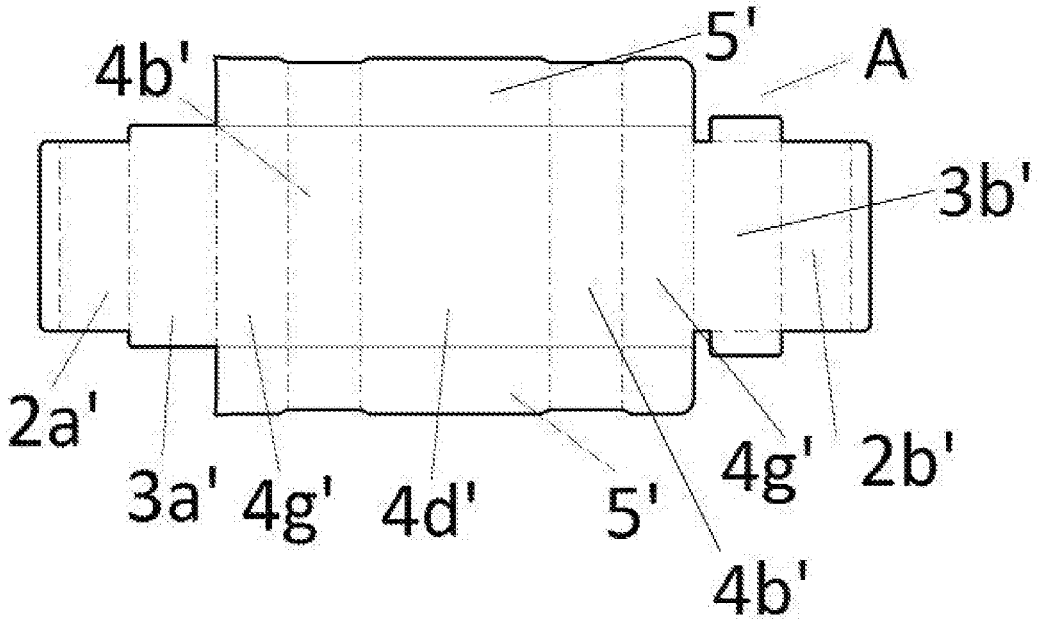
Figure 5:
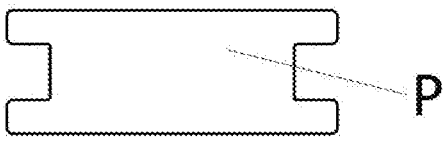
Figure 6A:
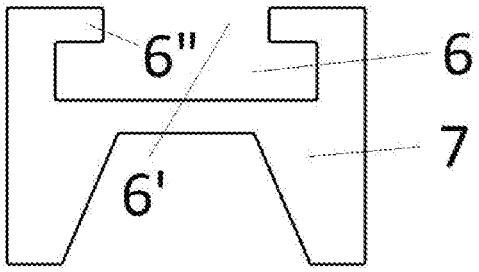
Figure 6B:
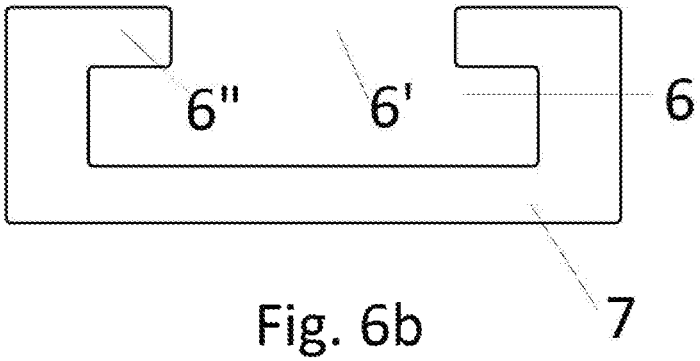
Figure 7:
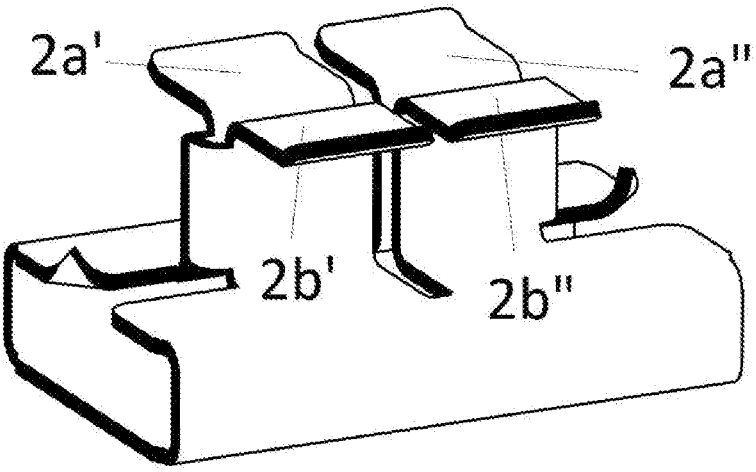
Figure 8:
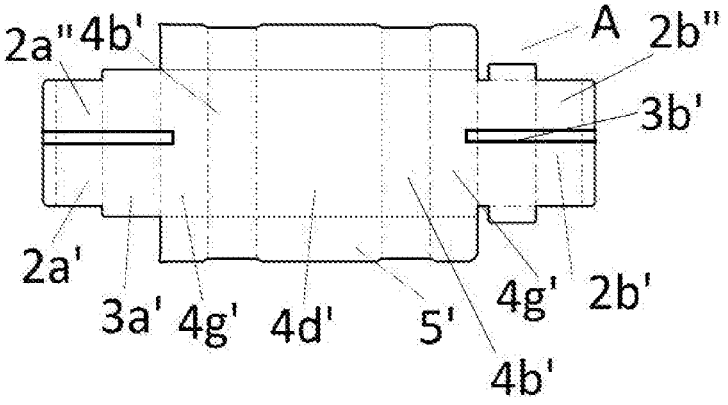

Examples of embodiment of the invention are shown on the appended drawing including the following figures:

FIG. 1 presenting a perspective view of a first embodiment of the securing clip according to the invention;

FIG. 2 presenting a perspective view of a second embodiment of the securing clip according to the invention;

FIG. 3 showing a plan view of the sheet material of which the securing clip shown in FIG. 2 is made;

FIGS. 4*a*-4*d* show perspective views of the system according to the invention in successive stages of installation;

FIG. 5 presents an exemplary cross-section of a flooring element;

FIGS. 6*a*-6*b* present exemplary cross-sections of a supporting element;

FIG. 7 presents another example of embodiment of the securing clip according to the invention;

FIG. 8 presents the sheet material of which the securing clip shown in FIG. 7 is made.

The securing clip 1 according to the first embodiment, shown in FIG. 1, has a cross-section shaped as a double-flange T with an upper flange 2, a web 3 and a lower flange 4. The upper flange 2 consists of two parts 2*a* and 2*b*, each on one side of the web. The lower flange has two lips 5 extending along the web 3 and symmetrically beyond the web 3 on both sides thereof. The upper flange 2 is made of elastic material. The securing clip may be made e.g. of steel or another suitable material, the only limitation being the elasticity of the upper flange 2 allowing for its engagement with the flooring elements, which will be explained below.

FIG. 2 shows a second embodiment of the securing clip according to the invention. In this embodiment, the whole securing clip 1' is made of a single sheet A of the elastic material, the sheet having a shape shown in FIG. 3. The securing clip 1' may be formed by repeated bending of the sheet A around the axes indicated by intermittent lines in FIG. 3.

As may be seen in FIG. 2, in this embodiment the securing clip 1', similarly as the securing clip 1, has an upper flange 2' composed of two parts 2*a'* and 2*b'*, a web 3' and a lower flange 4' with the lips 5' extending along the web 3' and beyond it. However, in this case the lower flange 4' consists of a lower wall 4*d'*, two side walls 4*b'* and two upper walls 4*g'*; the web also consists of two neighboring walls 3*a'* and 3*b'* (see FIG. 3).

The sheet A shown in FIG. 3 is to be bent several times in such a way that the lower wall 4*d'* of the lower flange 4' is formed by a central section of the sheet, while the side walls 4*b'* and the upper walls 4*g'* of the lower flange 4' are formed by the sections adjoining the central section symmetrically on both sides. The web 3' consists of the two sections 3*a'* and 3*b'* of the sheet that adjoin the sections of the upper walls 4*g'* on both sides, the sections 3*a'* and 3*b'* of the web 3' being shorter than the sections forming the lower flange 4'. One of the web sections 3*b'* has additional projections for closing the web 3' upon the bending of the sheet. Both parts 2*a'* and 2*b'* of the upper flange 2' are formed by the mutually opposing border sections of the sheet A.

The securing clips shown in FIG. 1 and FIG. 2 may be used for installation of the flooring elements P on the supporting elements 7 provided with guides 6.

Figure 4A:
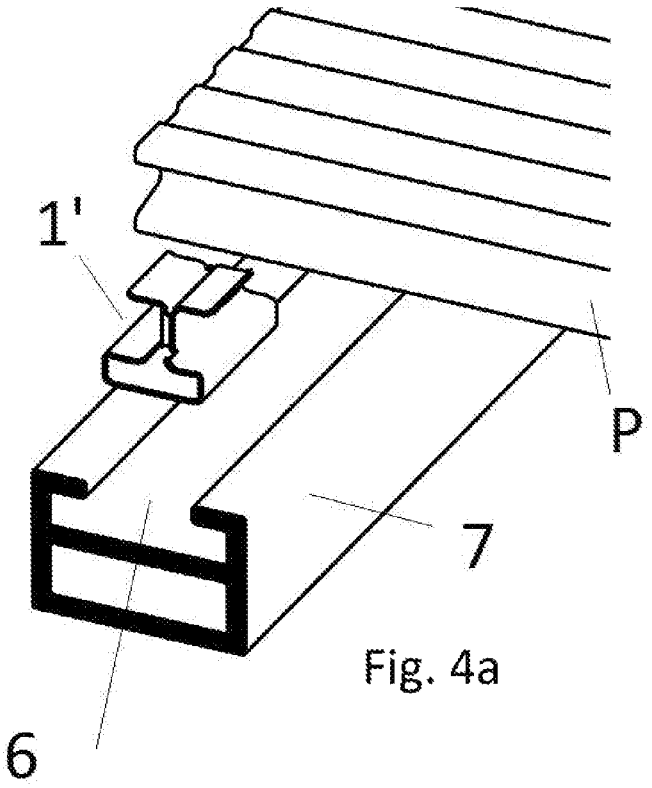
Figure 4B:
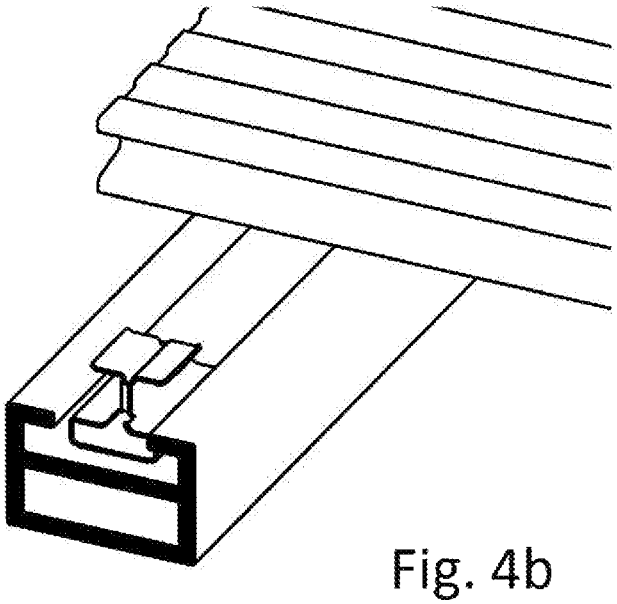
Figure 4C:
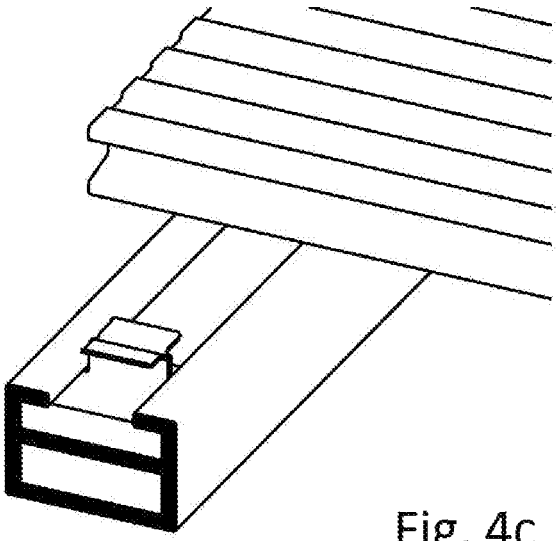
Figure 4D:
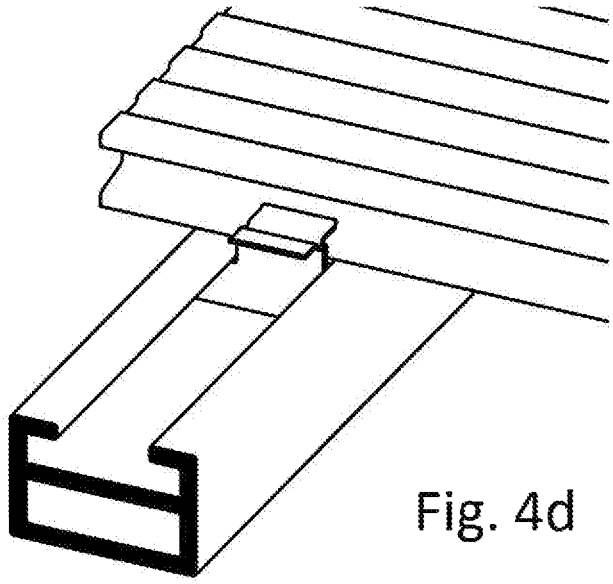

FIGS. 4*a*-4*b* show a system for installation of flooring elements, the system comprising one supporting element and one securing clip according to the invention. The figures show successive steps of the installation process.

As may be seen in FIG. 4*a*, the successive flooring elements, e.g. planks P are laid one after another on the supporting elements, in this case the joists 7. Each joist has a guiding groove 6 with an opening 6' (see FIG. 6*a*) in which the successive securing clips 1' are mounted. In the embodiment shown in FIGS. 4*a*-4*b* the flooring elements P are constituted by decking planks provided with upper and lower flanges, having a cross-section as shown in FIG. 5. However, the flooring elements may have any other form, also with a rectangular cross-section suitable to be fitted in between the upper flange 2, 2' and the lower flange 4, 4' of the securing clip 1, 1'.

In FIG. 4*a*, the securing clip 1' according to the second embodiment (it could also be the securing clip 1 according to the first embodiment) is shown in a situation directly before being fitted in the guiding groove 6 of the joist 7. The securing clip is inserted into the guiding groove in such a way that its web 3' is oriented along the groove 6. The dimension (as measured across the web 3') of the lower flange 4' of the securing clip 1' of the system according to the invention is smaller than the width d of the groove opening 6'. Hence, in the position shown in FIG. 4*b* the lower flange 4' may be easily inserted into the groove opening 6'. Then, the securing clip is rotated by 90° so as its web 3' gets oriented in the direction across the joist 7 and the guiding groove 6—FIG. 4*c*, after which the securing clip is brought close to the edge of the plank P being installed—FIG. 4*d*. If the plank has a cross-section shown in FIG. 5, one part of the upper flange 2' is to be engaged with the lower flange of the plank P. If the plank has a rectangular cross-section, the securing clip embraces it on one side. The free edges of the upper flange 2' may be slightly bent upwards, which facilitates engagement of the securing clip with the plank P or its flange. In the position shown in FIG. 4*d*, the securing clip 1' is blocked in the guiding groove by means of its lips 5 due to the fact that the dimension along the web 3' of its lower flange 4' is bigger than the width d of the groove opening 6'. Upon bringing the securing clip 1' close to the edge of the plank P, one of the parts 2*a'* or 2*b'* of the upper flange 2' of the securing clip 1', may be pressed by force against the lower flange of the plank thanks to the elasticity of the part 2*a'*. In a preferred embodiment, one of the upper walls 4*g'* of the lower flange 4' is provided with means for enhancing the blocking of the lips 5' in the guiding groove 6. In the described embodiment, the blocking enhancing means are formed as the free corners 8' of the upper wall 4*g'* that have been bent towards the upper flange 2'. Clearly, a specialist may choose another suitable blocking means instead of the upwardly bent corners. The securing clip 1' should be installed in such a way that the bent corners of the upper wall 4*g'* are on the side of the operator i.e. on the side opposite to the part 2*a'* or 2*b'* that is currently being engaged with the flooring plank P.

The securing clip 1' should be made of material that enables suitable bending of the sheet and having elasticity chosen to fulfill the task of reliable engagement of the securing clip with the flooring element. A specialist will easily select a suitable material, e.g. steel or plastic.

In order to demount the flooring plank P it is enough to remove the securing clip 1' or 1 from the plank, to rotate it by 90° and to take it out of the guiding groove 6. If the upper wall 4*g'* has the upwardly bent corners 8', the securing clip should be pressed downwards while being removed.

FIG. 5 shows an exemplary cross-section of a flooring element P having flanges along its lower and upper edges, the flanges enabling the engagement of the flooring element with the securing clips according to the invention. As mentioned above, the flooring elements having a rectangular cross-section (not shown) may also be secured by the securing clips according to the invention, in which case the clips catch the upper side of a flooring element.

FIGS. 6*a*-6*b* present exemplary cross-sections of supporting elements 7, i.e. joists; each of them has a guiding groove 6 with an opening 6' into which a securing clip 1, 1' is inserted and blocked within by means of the blocking flanges 6". The joist may be made as a profiled plastic element.

In FIG. 7*a* variant of the securing clip 1' is schematically shown. Its upper flange comprises four parts 2*a*', 2*a*" and 2*b*', 2*b*". On each side of the web there are two parts 2*a*', 2*a*" or 2*b*', 2*b*". The web is composed of the parts 3', 3" that have been divided in half.

FIG. 8 shows a sheet of which the securing clip of FIG. 7 has been formed.

The invention claimed is:

1. A securing clip for installation of flooring elements on a supporting element having a guiding groove for engagement with the securing clip, the securing clip having a cross section of a double-flange T type with an upper flange, a web and a lower flange, the upper flange being adapted to be engaged on its both sides with neighboring flooring elements, wherein the upper flange (2') comprises at least two parts (2*a*', 2*b*') located on the opposite sides of the web (3') and the lower flange (4') comprises lips (5') extending beyond each end the web (3') in the direction along the web (5'), the lips (5') being blocked in the guiding groove (6), characterized in that the securing clip is made of a single piece of an elastic sheet material that has been repeatedly bent so that:

the lower flange (4') consists of a lower wall (4*d*'), two side walls (4*b*') and two upper walls (4*g*') that are parallel to the lower wall (4*d*'), and the lower wall (4*d*') is formed by a central section of the sheet material, the side and upper walls (4*b*', 4*g*') are formed by the sections of the sheet material adjoining the central section on its both sides, the web (3') consists of two sections of the sheet material adjoining on both sides the sections of the upper walls (4*g*'), with the sections forming the web (3') being shorter than the sections forming the lower flange (4'), and the parts of the upper flange (2') being formed by the two opposite border sections of the sheet material.

2. The securing clip according to claim 1, characterized in that the upper flange (2') comprises four parts (2*a*', 2*a*", 2*b*', 2*b*"), the first pair (2*a*', 2*a*") of said parts being located on one side of the web (3') and the other pair (2*b*', 2*b*") of said parts being located on the other side thereof, wherein said two sections of the web (3') are divided into two parts, adjoining on both sides the sections of the upper walls (4*g*').

3. The securing clip according to claim 1, characterized in that one of the upper walls (4*g*') of the lower flange (4') is provided with means for enhancing the blocking of the lips (5') of the lower flange (4') in the guiding groove (6).

4. The securing clip according to claim 3, characterized in that the blocking enhancing means are constituted by free corners (8') of the upper wall (4*g*') that have been bent towards the upper flange.

5. The securing clip according to claim 1, characterized in that the external edges extending along the web (3') of all the parts of the upper flange (2') are bent away from the lower flange (4').

6. The securing clip according to claim 1, characterized in that it is made of steel.

7. A system for installation of flooring elements, the system comprising at least one securing clip (1') according to claim 1 and at least one supporting element (7) comprising a guiding groove (6) for engagement with the at least one securing clip (1'), the dimension of the lower flange (4') of the securing clip (1') measured across the web (3') being smaller than the width of the opening (6') of the guiding groove (6), and the dimension of the lower flange (4') of the securing clip (1') measured along the web (3') being greater than the width of the opening (6') of the guiding groove (6).

8. The system according to claim 7, characterized in that the supporting element (7) is a joist comprising a longitudinal guiding groove (6) at its side adjoining the flooring elements, the opening (6') of the guiding groove (6) being bordered on both sides by longitudinal blocking flanges (6").

9. The system according to claim 8, characterized in that the joist is a profiled element made of plastic material.

* * * * *